United States Patent [19]

Aronson

[11] Patent Number: 5,076,438

[45] Date of Patent: Dec. 31, 1991

[54] SERVING TRAY WITH AN UNDERSIDE MOLDED TO THE CONTOUR OF THE HAND OF THE SERVER

[76] Inventor: Michael D. Aronson, 1333 Bennington Ave., Pittsburgh, Pa. 15217

[21] Appl. No.: 508,261

[22] Filed: Apr. 11, 1990

[51] Int. Cl.[5] ..... B65D 1/34

[52] U.S. Cl. ..... 206/557; 206/563; 220/94 A; 229/1.5 H; 264/222; D7/543

[58] Field of Search ..... 206/557, 562, 563, 264; 220/17.1, 94 A; 229/1.5 H, 904; D7/302, 318, 319, 393, 543, 544, 545, 547, 549; D3/107, 303, 305; 264/219, 220, 222

[56] References Cited

U.S. PATENT DOCUMENTS

| | | | |
|---|---|---|---|
| D. 160,567 | 10/1950 | Wylie | 220/94 A |
| D. 166,521 | 4/1952 | Bernstein | D8/303 |
| D. 192,866 | 5/1962 | Crenshaw | D8/303 |
| D. 193,200 | 7/1962 | Bergeron | D7/545 |
| 169,188 | 10/1875 | Novinsky | 206/557 |
| 578,389 | 3/1897 | Challis | 220/256 |
| 745,322 | 12/1903 | Burrough | 220/324 |
| 1,202,761 | 10/1916 | Crabtree | 220/8 |
| 1,953,933 | 4/1934 | Gundelach | D7/543 |
| 2,389,882 | 11/1945 | Wood, Jr. | D7/393 |
| 2,558,650 | 6/1951 | Heineman et al. | 264/222 |
| 2,647,678 | 8/1953 | Olson | 229/904 |
| 2,712,160 | 7/1955 | Sterczek | 264/222 |
| 3,537,498 | 11/1970 | Amand | 220/94 A |
| 3,680,763 | 8/1972 | Ludder | 229/1.5 B |
| 3,941,286 | 3/1976 | Perkinson | 206/557 |
| 4,719,063 | 1/1988 | White | 264/222 |
| 4,746,057 | 5/1988 | Wagner | 220/94 A |
| 4,785,495 | 11/1988 | Dellis | 264/222 |
| 4,903,690 | 2/1990 | Campbell | 264/222 |

*Primary Examiner*—David T. Fidei

*Attorney, Agent, or Firm*—Reed Smith Shaw & McClay

[57] ABSTRACT

The present serving tray is formed with an underside having a recess therein which is contoured to the shape of a human hand. When the serving tray is used, the server's hand fits comfortably and securely within this contoured recess, thereby obtaining greater control over the serving tray than is possible with serving trays currently in use. The recess of the present serving tray is preferably contoured to conform to the shape, size and preferred position of a particular server's hand.

6 Claims, 2 Drawing Sheets

SERVING TRAY WITH AN UNDERSIDE MOLDED TO THE CONTOUR OF THE HAND OF THE SERVER

FIELD OF THE INVENTION

The present invention relates to a serving tray, especially to a serving tray with an underside formed so as to conform to the contour of a server's hand.

BACKGROUND OF THE INVENTION

Very often in crowded restaurants, lounges and other related service industries, servers are required to carry heavily laden trays by balancing them on one hand. Because of crowded conditions, a necessity to work quickly, and serving trays which are often slippery and otherwise difficult to carry, servers often loose their grasp or balance of the serving tray and spill its contents. These accidents usually result in broken glassware, disgruntled customers and ultimately lost revenue.

It takes a great deal of experience before the average person is capable of balancing a laden tray on one hand and carrying it through a crowded room with a fair degree of success. Owners of restaurants and lounges, thus, expend non-trivial amounts of time and funds training their employees. Even the most highly skilled server, however, remains prone to the accidents described above.

Moreover, the above-described accidents involving serving trays are not limited to restaurants and lounges. Such accidents are also common occurrences in the average household.

It would be desirable, therefore, to develop a serving tray with an improved structural design reducing both the frequency of accidental spills and the amount of skill required of the server.

SUMMARY OF THE INVENTION

Generally, the present invention relates to a serving tray with an underside formed with a recess therein, said recess having the contour of a human hand. When carrying the serving tray, the server's hand fits comfortably and securely within the contoured recess.

The present invention is particularly advantageous in several respects. First, the contoured recess enables the server to maintain much greater control while carrying the present serving tray than is possible with serving trays currently in use. The frequency of accidental spills and the skill required of servers is thereby greatly reduced. The present invention is also simply designed and inexpensive to produce. Serving trays currently in use can easily be converted to the present invention. Finally, the contoured recess of the present invention can be tailored to the size, shape and preferred position of an individual server's hand to achieve maximum control over the serving tray.

Other details, objects and advantages of the present invention will become more readily apparent from the following description of the presently preferred embodiments and presently preferred methods of practicing the invention.

BRIEF DESCRIPTION OF THE DRAWINGS

In the accompanying drawings, a preferred embodiment of the present invention is illustrated, by way of example only, wherein.

DESCRIPTION OF THE PREFERRED EMBODIMENT

Figure 1:
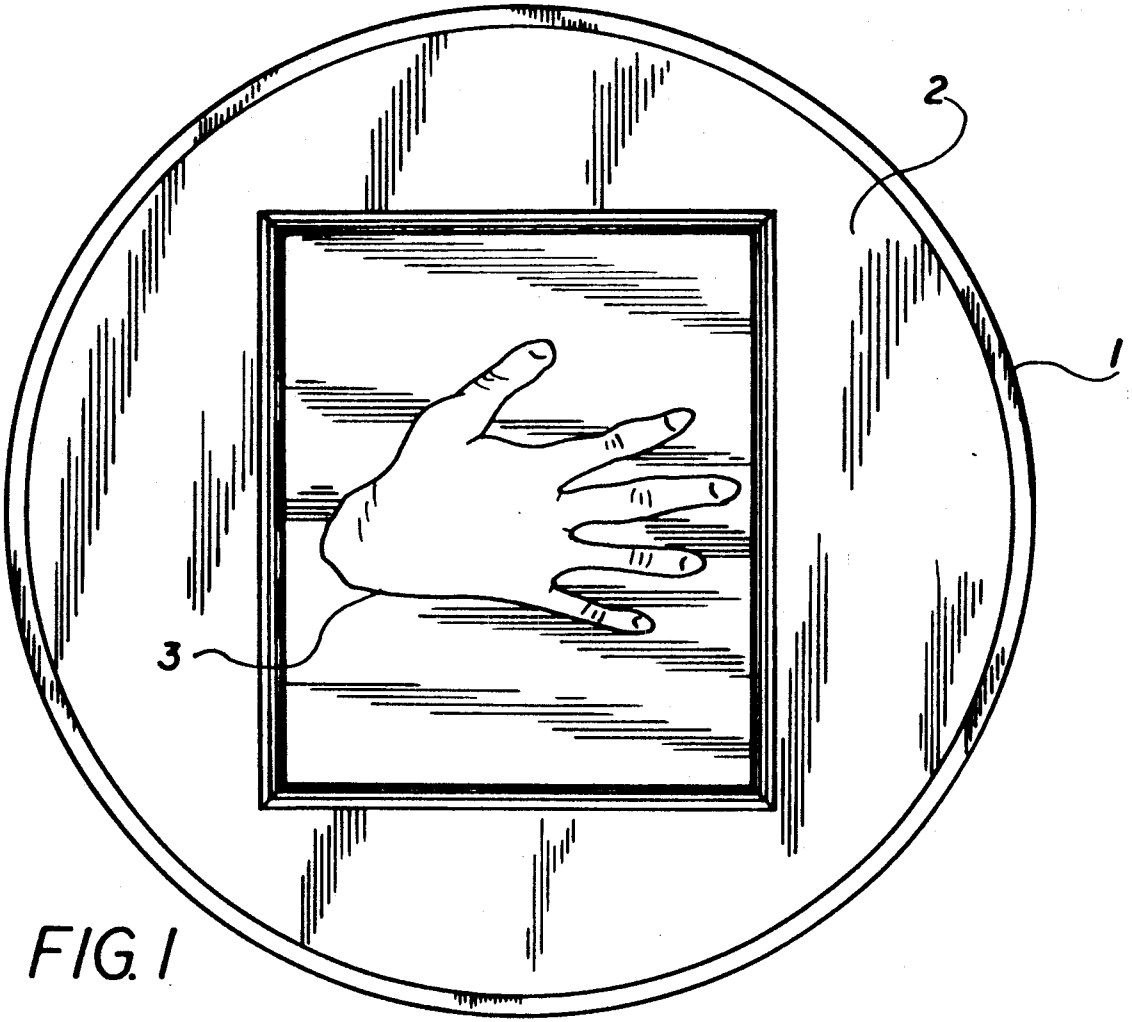
FIG. 1 is a bottom view of one embodiment of the serving tray.

As shown in FIG. 1, the present invention provides a serving tray 1 with an underside 2 formed with a recess 3 therein. The recess 3 has the contour of a human hand. When the serving tray 1 is carried, the server's hand is placed within the recess 3 to assist in maintaining control over the serving tray.

In a preferred embodiment of the present serving tray 1, the recess 3 is formed in the underside 2 of the serving tray 1 itself. The recess 3 can be contoured so as to accommodate a wide variety of shapes and sizes of human hands.

To obtain optimal control, however, the recess 3 is preferably contoured to the size, shape and preferred position (e.g., with the palm flat and parallel to the underside 2 of the serving tray 1 or with the hand in a "cupped" position so that the bulk of the load is carried on the fingertips) of a particular server's hand. In a most preferred embodiment, the recess 3 is formed in a deformable material separate from the serving tray 1, thus creating an attachable underside 2. The deformable material can subsequently be attached to the bottom of a serving tray 1 through the use of an adhesive 4 means known in the art, such as mastic or epoxy cement, or by the adhesive nature of the deformable material itself.

Suitable deformable materials include those having a yield stress such that the contoured recess 3 can be formed by the server placing his or her hand on the material and applying appropriate force to overcome the yield stress. The material is thereby deformed to create a contoured recess 3 or impression of the server's hand. The yield stress of the material is preferably such that the material will maintain the desired contour when subsequently exposed to the stresses accompanying use of the serving tray 1. Such deformable materials include polyurethane and polystyrene foams.

Other examples of suitable deformable materials include plaster-like materials wherein a contoured recess 3 of a server's hand can be made while the material is "wet". The material is subsequently "hardened" to permanently retain the recess 3. Such deformable materials include plaster or clay.

The above materials are readily available and inexpensive. By forming the contoured recess 3 in a deformable material separate from the serving tray 1, serving trays currently in use can be easily converted to the present invention. The attachable underside 2 is also easily replaced after becoming worn or to conform to the size, shape and preferred position of a different server's hand.

Whether the contoured recess 3 is formed in the underside 2 of the serving tray 1 or in a separate deformable material to be attached to the bottom of the serving tray 1, the center of the recess 3 (i.e., the center of balance of the server's hand) is preferably located so as to be substantially aligned with the center of gravity of the serving tray 1.

Figure 2:
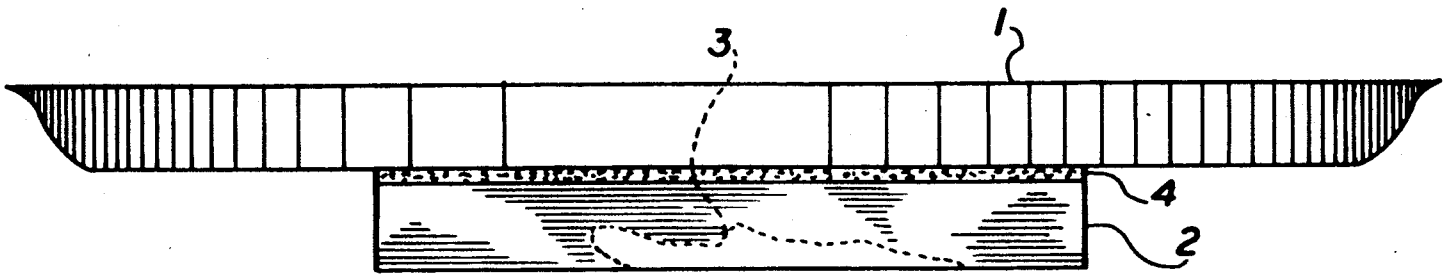
FIG. 2 is a perspective side view of the serving tray shown in FIG. 1.

As shown in FIG. 2, the area of the underside 2 surrounding the recess 3 preferably remains flat and of sufficient surface area so that the serving tray 1 will be stable when placed on a flat surface.

While a presently preferred embodiment of practicing the invention has been shown and described with particularity in connection with the accompanying drawings, the invention may otherwise be embodied within the scope of the following claims.

What is claimed is:

1. A serving tray with an underside formed with a depressed recess therein, the center of said recess being substantially aligned with the center of gravity of the serving tray, said recess having the contour of a human hand such that a server's hand fits within the recess during use of the serving tray and said depressed recess being formed in a deformable material capable of maintaining the contour of the server's hand when exposed to the stresses accompanying use of the serving tray, said deformable material being attached to the underside of the serving tray through adhesive means, thereby assisting the server to maintain control over the serving tray.

2. A serving tray as described in claim 1 wherein the recess is formed in a deformable material capable of maintaining the contour of a server's hand when exposed to the stresses accompanying use of the serving tray, said deformable material being attached to the underside of the serving tray through the adhesive nature of the deformable material itself.

3. A serving tray as described in claims 1 or 2 wherein the deformable materials is a polyurethane foam.

4. A serving tray as described in claims 1 or 2 wherein the deformable material is a clay.

5. A serving tray as described in claim 1 or 2 wherein the deformable material is a polystyrene foam.

6. A serving tray as described in claim 1 or 2 wherein the deformable material is plaster.

* * * * *